US008468659B2

(12) United States Patent
Litanzios

(10) Patent No.: US 8,468,659 B2
(45) Date of Patent: Jun. 25, 2013

(54) FIXING DEVICE

(76) Inventor: Philip Litanzios, London (GB)

( * ) Notice: Subject to any disclaimer, the term of this patent is extended or adjusted under 35 U.S.C. 154(b) by 252 days.

(21) Appl. No.: 12/812,505

(22) PCT Filed: Jan. 9, 2009

(86) PCT No.: PCT/GB2009/000051

§ 371 (c)(1),
(2), (4) Date: Jul. 12, 2010

(87) PCT Pub. No.: WO2009/087386

PCT Pub. Date: Jul. 16, 2009

(65) Prior Publication Data

US 2010/0287746 A1 Nov. 18, 2010

(30) Foreign Application Priority Data

Jan. 11, 2008 (GB) ..... 0800442.6

(51) Int. Cl.
*F16B 5/06* (2006.01)

(52) U.S. Cl.
USPC ..... 24/498; 403/322.4; 403/374.5

(58) Field of Classification Search
USPC ..... 403/205, 403, 382, 170–176, 343, 403/385, 374.1, 374.5, 322.4; 52/204.64, 52/604.65, 766, 767, 584.1; 24/498
See application file for complete search history.

(56) References Cited

U.S. PATENT DOCUMENTS

| | | | | |
|---|---|---|---|---|
| 1,987,826 | A * | 1/1935 | Heumann | 403/73 |
| 2,761,476 | A | 9/1956 | Gunas | |
| 4,033,570 | A | 7/1977 | Curlow | |
| 6,231,266 | B1 | 5/2001 | Gott | |
| 2007/0033886 | A1 * | 2/2007 | Friegang | 52/127.5 |

FOREIGN PATENT DOCUMENTS

DE 930544 C 7/1955

OTHER PUBLICATIONS

International Search Report published Jul. 16, 2009 for PCT/GB2009/000051, filed Jan. 9, 2009.
International Preliminary Report on Patentability published Jul. 13, 2010 for PCT/GB2009/000051, filed Jan. 9, 2009.
Written Opinion published Jul. 11, 2010 for PCT/GB2009/000051, filed Jan. 9, 2009.

* cited by examiner

*Primary Examiner* — James Brittain
(74) *Attorney, Agent, or Firm* — Martin Fleit; Paul D. Bianco; Fleit Gibbons Gutman Bongini & Bianco PL

(57) ABSTRACT

A device for fixing a first and second object with respect to one another includes a base which has a first channel or sleeve and a second channel or sleeve each suitable for receiving the first and second objects, respectively. A first member is and a second member are movably connected to the base. The first and second members can be moved into a locking position whereby the first member projects into the first channel, and the second member extends into the second channel.

19 Claims, 3 Drawing Sheets

FIXING DEVICE

FIELD OF THE INVENTION

This invention relates to a device for fixing two objects with respect to one another.

BACKGROUND TO THE INVENTION

Modern design practice often focuses on clean lines and simple presentation. For this reason glass is often used. However, consumers also demand flexibility from their products, with a high demand for furniture and other goods that can be reconfigured for multiple uses. Meanwhile, the demands of manufacturing and shipping have created a strong pressure to provide easily packaged and stored products that can be flat packed for later assembly. However, because glass is fragile and hence difficult to use, and flexibility is difficult to achieve in design while still providing a reliable produce, it is very difficult to meet all of these goals. A device that can be used unobtrusively to fit together complex constructions from glass and other materials simply and easily, without even the need for a screwdriver, would be extremely useful.

SUMMARY OF THE INVENTION

The invention provides a device for fixing a first object and a second object with respect to one another. The device comprises a base, the base comprising a first channel and a second channel suitable for receiving the first and second objects respectively. The device further comprises a first member which is movably connected to the base and a second member which is also movably connected to the base. The first and second members can be moved into a locking position whereby the first member projects into the first channel and the second member projects into the second channel to retain the objects in their respective channels, in use.

In this way the invention provides a device into which the two objects to be secured can be inserted before being held in place by the action of the first and second member. By locking the first and second member, the first and second objects are secured in the channels so that their position and orientation with respect to each other is precisely determined.

The device is made from materials chosen to suit the objects that are to be fastened together. Therefore the base, the first member and the second member can be made from metal, wood, glass, polymers such as plastics or any other materials that are suitably strong to support the object. Often the base, the first member and the second member will be made from the same material. Where the objects to be fastened are transparent glass or plastic panels, the base, the first member and the second member may be made out of a clear plastics material so that they are of suitable appearance to suit the glass but also strong and resilient in use.

If the first and second members do not provide enough friction to hold the first and second objects in place, then they can be provided with a high-friction surface at the point at which they extend into the first and second channels when in a locked position. Typically, the first and second member will each comprise a stud on the member at the point at which they extend into a channel when in a locked position. A rubber or elastomer O-ring can then be fitted to this stud to provide the necessary friction. Alternatively, the member can be provided with a coating of a suitably high-friction material.

In a preferred embodiment, the first member and the second member are movable with respect to the base while projecting into the first channel and second channel respectively.

Therefore the first and second members can be manipulated so as to assist in moving the first and second objects into their respective channels before the members are locked in place, fastening the objects into position.

Typically, the first and second members each comprise a handle for moving the members into the locking position. It is often convenient to have the handles comprise the mechanism by which the first and second members are locked into place.

It may be that the first and second members are locked into position by connecting the first member to the second member. This can be done by providing the first member with at least one protrusion that will fit into at least one complementary indentation in the second member when the first and second members are in their locked position, provided that the movements of the first and second members are limited so that the protrusion cannot easily detach from the indentation. Alternatively, the first and second members can be locked in place using any suitable mechanical linkage such as a clasp or a bolt. Typically a mechanical linkage is used so that it can be easily undone when required, but the first and second member can also be fastened using more permanent bonding such as adhesive if this is desired.

In embodiments of the invention where the first and second members are locked into position by connecting the first member to the second member, it may also be that, in the locking position, the first and second members are locked into place by bracing the first member against a first object in the first channel and bracing the second member against a second object in the second channel.

In embodiments of the invention, the first member is substantially identical to the second member.

It may be that the first and second objects are substantially planar, such as panels of glass, metal or plastics.

Typically the first and second members are rotatably mounted to the base. The first and second members can be joined to the base using any suitable hinge. The axis of the rotation of the first member may be substantially parallel to the axis of rotation of the second member. Where this is the case, the axis of rotation of the first member may be substantially coincident with the axis of rotation of the second member.

In one embodiment of the invention the first and second members are rotatably mounted to the base and the first and second channels are substantially planar, it may be that the axes of rotation of the first and second members are substantially parallel to the planes of the first and second channels.

Where the first and second members are rotatably joined to the base, it may be that the first and second member each comprises a cam surface for engaging the first and second objects respectively.

In some embodiments of the invention, the base comprises a fastening suitable for attaching a caster. The base may comprise a cavity suitable for retaining a roller ball.

A device according to the invention as described above is used by inserting a first object into the first channel and a second object into the second channel. The first and second members are then manipulated so that they extend into the first and second channel respectively. The first and second members are then locked in place.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1:
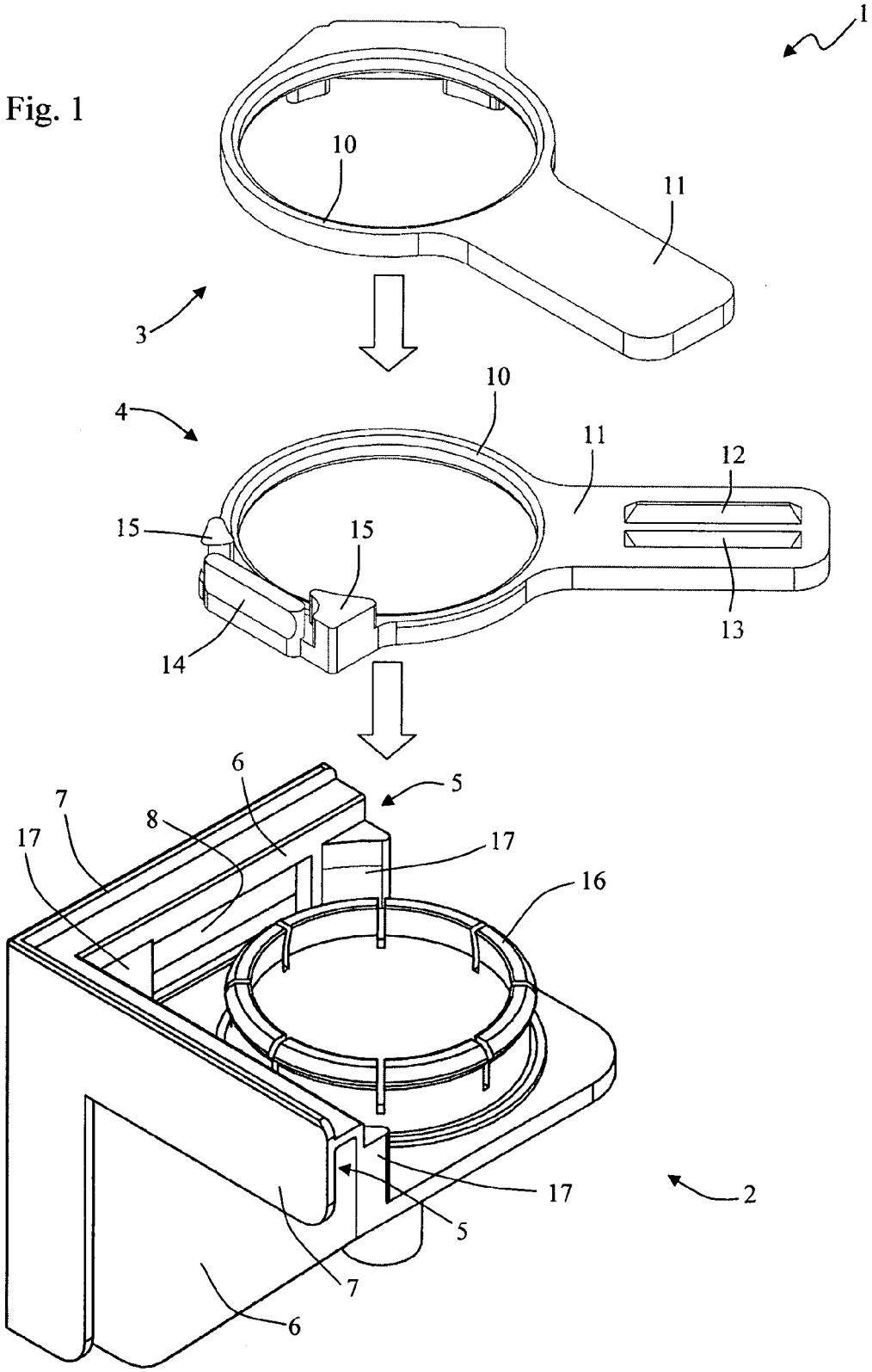
FIG. 1 is a diagram showing one embodiment of a device according to the invention before it is assembled.

FIG. 1 shows a primary device 1 for fixing two sheets of glass, or any other material suitable for being formed into sheets, with respect to one another according to the invention. The primary device 1 comprises a base 2, a first grip 3 and an identical second grip 4.

The base 2 comprises two sleeves 5 into which, in use, the sheets of glass are inserted. Each sleeve is formed from an inner wall 6 and an outer rim 7. Because the outer rim 7 will remain visible when the sheets of glass are inserted into the sleeves 5, even if the glass is opaque, the outer rims 7 are kept small for aesthetic reasons. The inner walls 6 extend over a larger area in order to support the sheets of glass. There is a slot 8 set into one inner wall 6 of the base 2, and another identical slot 9 set into the other inner wall 6 which is not visible in FIG. 1.

The grips 3, 4 each comprise a loop 10 which is provided with a handle 11. Set into the handle 11 are a protrusion 12 and an indentation 13. The dimensions of the protrusion 12 are identical to those of the indentation 13. The loop 10 is also provided with a primary stud 14 and two secondary studs 15, on the same surface of the grip 3, 4 as the protrusion 13. In use, the first grip 3 and second grip 4 are fastened onto a cylindrical clamp 16 on the base 2 as indicated in FIG. 1. A rubber O-ring is also fitted, in use, to the primary stud 14 of each grip 3, 4.

The grips 3, 4 are placed on the cylindrical clamp 14 so that the secondary studs 15 of the first grip 3 rest against the loop 10 of the second grip 4, and vice versa. When fastened to the cylindrical clamp 16, therefore, the grips 3, 4 are held in place both by the clamp and the secondary studs 15 on each grip 3, 4, but are free to rotate around the cylindrical clamp 16 except where prevented by the body of the base 2 or each other.

The base 2 also comprises three curbs 17, which help to guide the grips 3, 4 into place on the cylindrical clamp 16 and help to maintain a rigid angle between the different parts of the base 2 when it is placed under stress.

Figure 2:
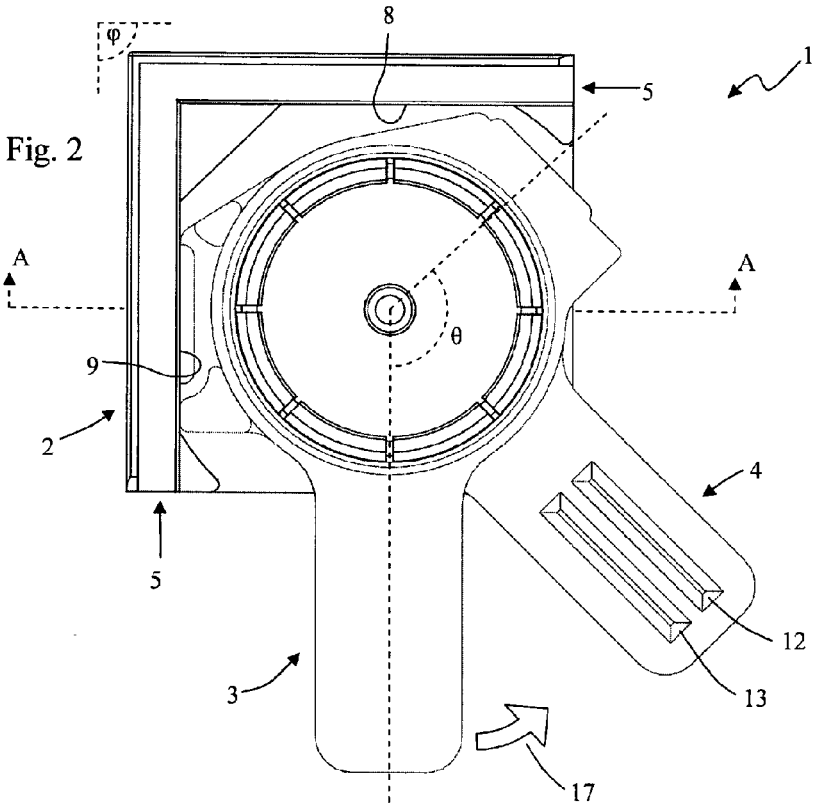
FIG. 2 is a diagram of the same device once it has been assembled.

FIG. 2 shows the primary device 1 with the grips 3, 4 fastened on the cylindrical clamp 16 of the base 2. To fasten two sheets of glass into position using the primary device 1, the sheets are first inserted into the sleeves 5. The first grip 3 is then rotated as indicated by the arrow 17 in FIG. 2 so as to bring the rubber O-ring on the primary stud 14 into contact with a sheet of glass through the slot 8. The second grip 4 is shown already in its final position in FIG. 2. As the handles 11 of the two grips 3, 4 are moved towards one another, the glass sheets are pushed further into the sleeves 15 by the frictional force exerted by the rubber O-rings on the primary studs 14. When the handles 11 of the two grips 3, 4 meet, the protrusion 12 on the first grip 3 fits into the indentation 13 on the second grip 4 and vice versa. This locks the two grips 3, 4 together, with the primary studs 14 in the slots 8, 9 so that the glass sheets are held in place with respect to each other and the base 2.

The angle between the two sheets of glass once they are locked into the primary device 1 is determined by the angle $\phi$ between the two sleeves 5. In the primary device 1 the angle $\phi$=90°. However, $\phi$ can be acute or obtuse if required. The angle $\theta$ is between the handle 11 and a tangent to the outward edge of the primary stud 14 on the grips 3, 4. If a base 2 is produced with a different value of $\phi$ then different grips 3, 4 with different values of $\theta$ must be provided as well. Provided that $\phi \approx 2\,(180° - \theta)$ it is possible for the grips 3, 4 to be locked together so that the O-ring on the primary studs 14 of the two grips 3, 4 is pressed against both of the sheets of glass, holding them in place at an angle $\phi$ to each other.

Figure 3:
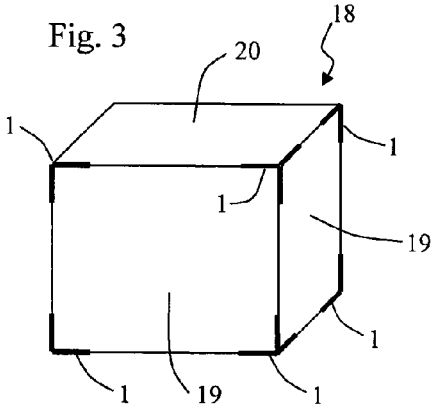
FIG. 3 shows a construction assembled using devices.

Devices according to the invention can be used to construct complex shapes from flat sheets and panels of multiple materials. FIG. 3 shows a glass box 18 assembled using eight primary devices 1 according to the invention. The box 18 is a cube and comprises five square sheets of glass 19, 20. Four of the glass sheets 19 are held in place by the eight primary devices 1, while the fifth glass sheet 20 rests on top of the assembly. It is prevented from slipping sideways by the upper part of the outer rims 7 on the primary devices 1.

Constructions formed using devices according to the invention have many potential uses. For example the glass box 18 can be used as a display case in a temporary exhibit, in which case it can be assembled quickly, used for as long as is desired, before being dismantled equally quickly and packed into a much smaller volume for storage or transport. Alternatively, devices according to the invention may be used to hold a construction together while some other form of bonding such as adhesive is applied. The devices can then be removed once the construction is supported by the other bonding, if this is required. This technique can be used to help create permanent constructions and constructions with sealed edges such as aquariums.

Figure 4:
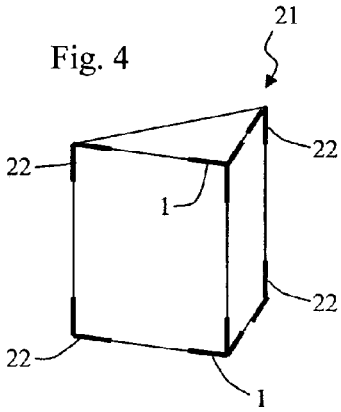
FIG. 4 shows a second construction assembled using devices.

Devices according to the invention are not limited to use in constructing cubes or cuboids. For example, FIG. 4 shows a second display case 21 similar to the one in FIG. 3, but with a cross section in the shape of a right-angled triangle. On two of the corners primary devices 1 where $\phi$=90° are used. However, on the other four corners secondary devices 22 are used. The secondary devices 22 are similar to the primary devices 1 except that they have $\phi$=45°. Many other shapes are possible using devices according to the invention, with the value of $\phi$ chosen for different devices as required.

Figure 5:
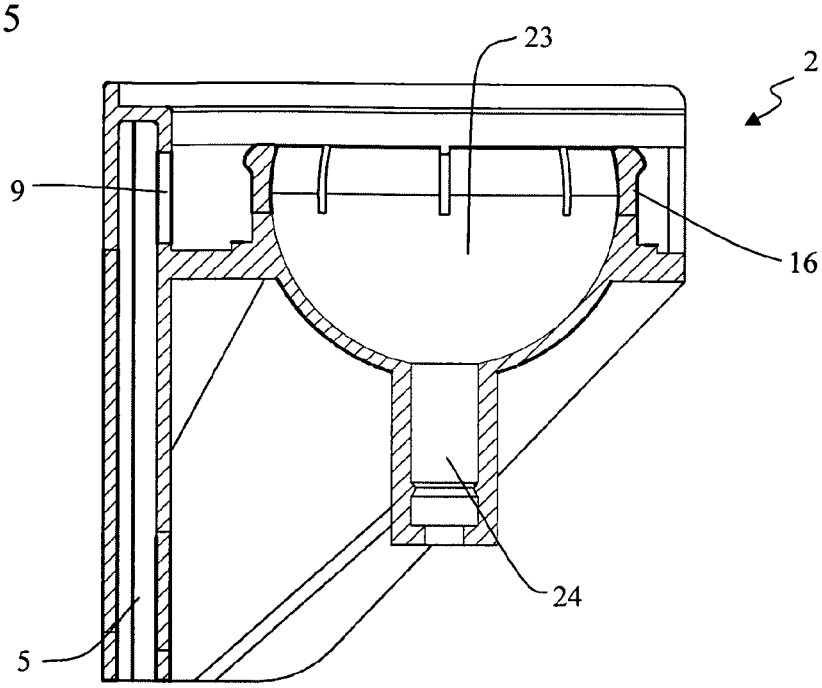
FIG. 5 shows a section A-A through the base of the device in FIG. 2.

FIG. 5 shows a section A-A through the base 2 in FIG. 2. In this embodiment of the invention the base 2 comprises a hemispherical cup 23 suitable for receiving a roller ball. The base 2 also comprises a shaft 24 into which a caster stud can be fitted so that a caster can be fitted. Therefore when the device 1 is used at the bottom of a case such as the ones in FIGS. 3 and 4 or some other construction, the base 2 can be fitted with a roller ball or caster as preferred so that the construction can be wheeled around. A rubber (or elastomer) ball can also be placed in the hemispherical cup 23. This would be useful in constructions such as the box 18 shown in FIG. 3, where a sheet of glass 20 is placed on top of a structure formed from devices 1 and other sheets of glass 19. The sheet of glass 20 can rest upon rubber balls placed in each of the four uppermost devices 1. This would help to prevent the sheet of glass 20 from moving and protect it from damage due to contact with other parts of the devices 1.

The invention provides a device 1 for fixing a first and second object with respect to one another. The device comprises a base 2, the base comprising a first channel or sleeve 5 and a second channel or sleeve 5 suitable for receiving the first and second objects respectively. The device 1 further comprises a first member 3 which is movably connected to the base 2 and a second member 4 which is also movably connected to the base 2. The first and second members 3, 4 can be moved into a locking position whereby the first member 3 projects into the first channel 5 and the second member 4 extends into the second channel 5.

The invention claimed is:

1. A device for fixing a first object and a second object with respect to one another, the device comprising:

a base comprising a first channel and a second channel suitable for receiving the first and second objects respectively;

a first member movably connected to the base; and a second member movably connected to the base, wherein the first and second members can be moved into a locking position whereby the first member projects into the first channel and the second member projects into the second channel to retain the objects in their respective channels, in use, and wherein the first and second members are locked into position by connecting the first to the second member.

2. A device as claimed in claim 1, wherein the first member and the second member are movable with respect to the base while projecting into the first channel and second channel respectively.

3. A device as claimed in claim 1, wherein the first and second members each comprise a handle for moving the members into the locking position.

4. A device as claimed in claim 1, wherein, in the locking position, the first and second members are locked into place by bracing the first member against a first object in the first channel and bracing the second member against a second object in the second channel.

5. A device as claimed in claim 1, wherein the second member is substantially identical to the first member.

6. A device as claimed in claim 1, wherein the first and second members are rotatably mounted to the base.

7. A device as claimed in claim 6, wherein the axis of rotation of the first member is substantially parallel to the axis of rotation of the second member.

8. A device as claimed in claim 7, wherein the axis of rotation of the first member is substantially coincident with the axis of rotation of the second member.

9. A device as claimed in claim 6, wherein the first and second channels are substantially planar and the axes of rotation of the first and second members are substantially parallel to the planes of the first and second objects.

10. A device as claimed in claim 6, wherein the first and second members each comprise a cam surface for engaging the first and second objects respectively.

11. A method for fixing two objects with respect to one another, the method comprising:

providing a device according to claim 1;

inserting a first object into the first channel and a second object into the second channel;

manipulating the first and second members so that they extend into the first and second channels respectively; and locking the first and second members in place.

12. A device for fixing a first object and a second object with respect to one another, the device comprising:

a base comprising a first channel and a second channel suitable for receiving the first and second objects respectively, the base having a fastening suitable for attaching a caster;

a first member movably connected to the base; and a second member movably connected to the base, wherein the first and second members can be moved into a locking position whereby the first member projects into the first channel and the second member projects into the second channel to retain the objects in their respective channels, in use.

13. A device for fixing a first object and a second object with respect to one another, the device comprising:

a base comprising a first channel and a second channel suitable for receiving the first and second objects respectively, the base having a cavity suitable for retaining a roller ball;

a first member movably connected to the base; and a second member movably connected to the base, wherein the first and second members can be moved into a locking position whereby the first member projects into the first channel and the second member projects into the second channel to retain the objects in their respective channels, in use.

14. A device for fixing a first object and a second object with respect to one another, the device comprising:

a base comprising a first channel and a second channel, each channel configured for receiving a portion of one of the first or second object, each channel having an aperture;

a first member having a portion projectable into the aperture of the first channel;

a second member rotatably connected to the base and having a cam portion and a portion reversibly projectable into the aperture of the second channel, whereby when the second member is rotated, the cam pushes the projectable portion of the first member into the aperture of the first channel, and the reversibly projectable portion of the second member projects into the aperture of the second channel.

15. The device of claim 14, further including an elastomeric material disposed upon the projectable portions of the first and second members, the elastomeric material of the first and second members positioned to contact the first and second objects, respectively, when the first and second objects are disposed within the first and second channels, and the second member is rotated.

16. The device of claim 14, the first and second members further including handles each having mutually mateable interlocking portions, the portions interlocking when the second member has been rotated to project the projectable portions of the first and second members.

17. The device of claim 14, wherein the first and second members are assembleable onto the base.

18. The device of claim 14, wherein the base further includes a socket sized and dimensioned to receive a caster.

19. A device as claimed in claim 14, wherein the first and second objects are substantially planar.

* * * * *